United States Patent [19]

Henn

[11] Patent Number: 5,049,096

[45] Date of Patent: Sep. 17, 1991

[54] VANED DIVERTER NOZZLE FOR JET BOATS

[76] Inventor: Jimmy D. Henn, 710 Wedgewood La., La Habra, Calif. 90631

[21] Appl. No.: 457,571

[22] Filed: Dec. 27, 1989

[51] Int. Cl.[5] ..... B63H 11/11; B63H 11/113

[52] U.S. Cl. ..... 440/041; 239/265.27; 239/265.35; 440/042

[58] Field of Search ..... 440/40-42; 60/221; 239/265.27, 265.35

[56] References Cited

U.S. PATENT DOCUMENTS

| | | | |
|---|---|---|---|
| 3,073,277 | 1/1963 | Lee | 60/221 X |
| 3,143,857 | 8/1964 | Eaton | 60/221 |
| 3,187,708 | 6/1965 | Fox | 440/41 |
| 3,756,185 | 9/1973 | Breslin | 440/42 |

*Primary Examiner*—Sherman Basinger
*Attorney, Agent, or Firm*—G. Donald Weber, Jr.

[57] ABSTRACT

An improved diverter unit for use with jet boats. The diverter unit includes an inlet unit which has a substantially tubular conduit therethrough. The inlet unit includes at least one radial vane which extends into and along the length of the conduit to control the direction and characteristics of fluid flow through the unit. An outlet unit also includes a substantially tubular conduit therethrough. A separate reverse outlet is disposed adjacent to the outlet unit but does not directly interface therewith. A reverse bucket is pivotally mounted to said outlet unit and selectively covers the outward end of said outlet unit to selectively direct fluid through said reverse outlet.

6 Claims, 2 Drawing Sheets

VANED DIVERTER NOZZLE FOR JET BOATS

BACKGROUND

1. Field of the Invention

This invention is directed to an accessory for use with jet boats, in general, and to an improved fluid diverter for use with such boats, in particular.

2. Prior Art

There is a vast segment of the world populace which enjoys various types of water sports and water recreation. This activity includes the use of boats which are driven by an impeller enclosed in a pump housing and powered, in most cases, by V8 engines. In jet boats, water is pulled into the pump housing through an opening covered by a metal grate and forced out of the housing at the stern of the boat by a rotating impeller. These pump driven boats are referred to as jet boats. The recreation activity can be the use of the boat as a pleasure craft, per se, or as an integral part of the water activity. For example, jet boating can take the form of various kinds of racing. While point-to-point racing based upon "pure straight ahead speed" is one example of this sport, the vast majority of such racing takes the form of "closed course racing".

In this type of event, a specified course is laid out in a body of water. The course is usually marked by buoys or the like. This type of race course requires certain strategy with regard to the path or track which the racer follows. Part of the skill of the racer is in knowing how and when to corner in order to obtain the least amount of lost time and distance in navigating the race course. Of course, the racer must know his (or her) equipment and the performance capabilites thereof. Naturally, if one boat has superior characteristics, any racer can perform better therein.

In related activities, various forms of water skiing are performed behind such a jet boat. Such water skiing can be purely recreational or it can be competitiive in terms of jumping, slaloming, trick skiing or the like.

Jet boats have achieved popularity for several reasons. For example, they tend to be quite fast. Also, they have extremely shallow draft and can operate in shallow water primarily because the jet boat does not have a screw-type propeller. Rather, the jet boat has an inboard engine (e.g. a V-8 engine) which directly drives a rotating impeller. The impeller is mounted in a housing which has an opening for admitting water which is pushed or "impelled" out of a nozzle at the end of the housing. However, the conventional nozzle has limited steering capability and the impeller produces a definite spiral flow to the water being forced out of the nozzle. These effects hinder the capability of the jet boat.

Again, in the recreational activity it is highly desirable to have a jet boat with optimum operational characteristics doing the pulling. The speed of the boat as well as proper level in the water are functions to be considered. That is, when pulling a skier, it is desirable for the stern of the boat and the skier to be brought to a level plane in the water more quickly and, therefore, rapidly attain desired speed.

Furthermore, if the tow boat has different operating characteristics when turning right versus turning left, the water skier can experience a turning problem as well.

The problem of different left or right turning characteristics of propeller driven power boats is notorious due to the different reactions produced by the propeller on the water. Likewise, jet boats tend to have a similar problem due to the spiral effect of the water which passes through the impeller mechanism thereof.

One accessory which has attained popularity to date is a diverter with an up-down nozzle. This unit is sold and manufactured by Place Diverter & Controls of La Habra, Calif., and is referred to as a Place Diverter. This diverter is attached to the existing outlet flange of the conventional jet boat impeller housing. The diverter, essentially, replaces the standard equipment output and rudder.

While the Place Diverter is an adequate unit to assist in providing some of the advantages noted above, the Place Diverter still retains a number of drawbacks. For example, water passes through this unit in a spiral motion, which is generated by the jet boat impeller. The spiral motion seems to be emphasized by the configuration of the Place Diverter unit. Moreover, the Place Diverter unit produces an inordinate amount of drag on the jet boat due to the shape of the reverse outlet in the "open" condition That is, the known diverters cause the water which flows through the reverse outlet to be directed into the outlet path. This tends to create turbulence and, thus, drag on the boat. The prior art reverse outlet tends to structurally interfere with the normal outlet and/or to deflect the reverse outlet water flow into the normal outlet water flow because of the shape of the reverse outlet. For example, many such prior art devices are curved so that the reverse outlet water flow is almost caused to flow into the outlet unit.

Consequently, it is highly desirable to provide an improved diverter unit with a minimum of overall alteration of existing boats, diverter mountings and diverter controller systems.

PRIOR ART STATEMENT

There are no known prior art patents directed to jet boat diverters.

SUMMARY OF THE INSTANT INVENTION

This invention comprises a fluid diverter which is adapted to be mounted to the output of the impeller housing of a jet boat. This mounting permits side-to-side motion of the diverter. The diverter includes an inlet unit which has a generally tubular aperture passing axially therethrough. An outlet unit is pivotally mounted to one end of the inlet unit. This mounting permits up-and-down motion of the outlet unit of the diverter. The outlet unit includes a generally tubular aperture passing axially therethrough and communicates with the aperture of the inlet unit. At least one vane extends radially into the aperture and along the length of at least the inlet and/of outlet unit.

A reverse outlet is mounted adjacent the outlet unit and comprises a generally oblate cylinder with an axial aperture passing therethrough. The aperture in the reverse outlet is generally parallel to the aperture in the outlet unit wherein water flow through the reverse outlet does not significantly interfere with water flow through the inlet/outlet units in the normal configuration. As a result, improved operation of the boat is achieved in the forward direction as well as in low speed steering capability.

A reverse bucket unit is pivotally mounted to the outlet unit and selectively covers the outward end of the aperture of the outlet unit. The reverse bucket unit diverts fluid at the outlet end of the aperture in the outlet unit through the reverse outlet. Thus, the apertures in the inlet unit, outlet unit and the reverse bucket are selectively interconnected when the reverse bucket unit closes the outlet aperture.

DESCRIPTION OF A PREFERRED EMBODIMENT

Figure 1:
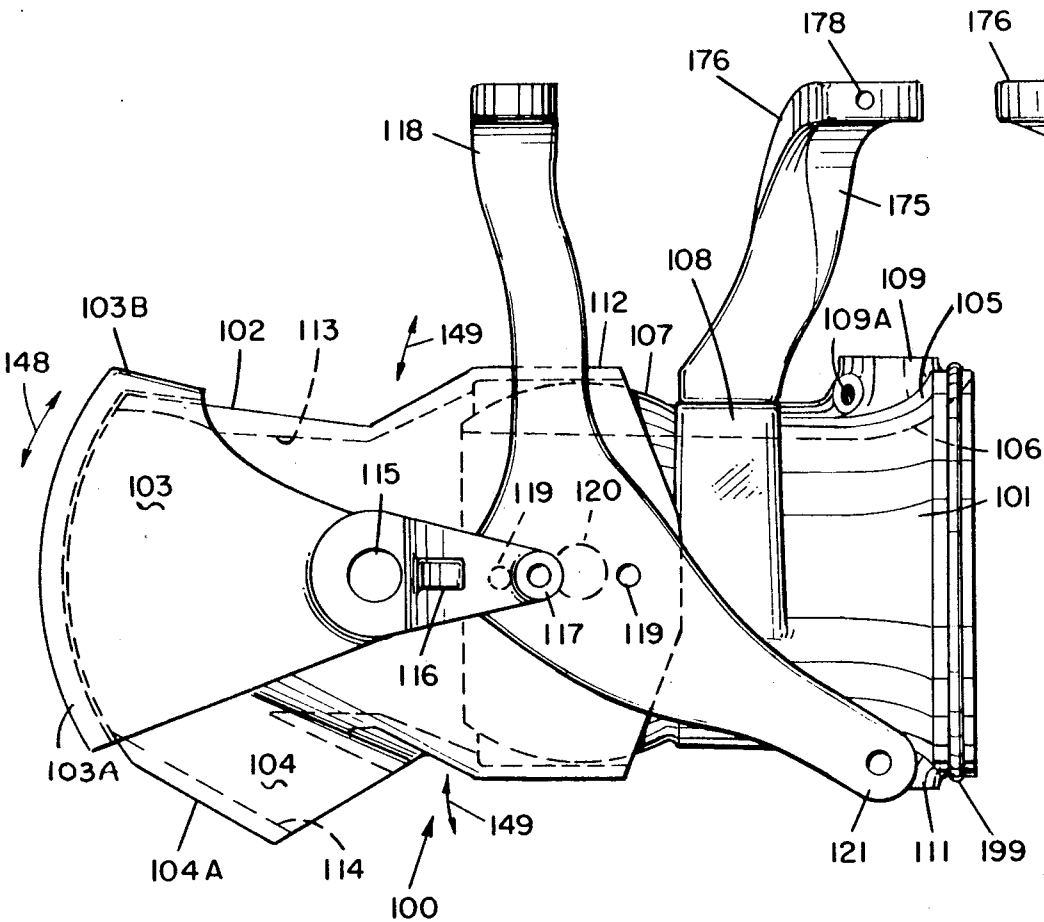
FIG. 1 is a side view (partially in phantom line) of a preferred embodiment of the improved diverter unit of the instant invention.

Referring now to FIG. 1, there is shown a side view of the invention including phantom lines and broken away portions for convenience. The diverter 100 includes an inlet portion 101, an outlet portion 102, a reverse bucket 103 and a reverse outlet 104. In particular, several components of the diverter 100 are fabricated from suitable materials such as cast aluminium or similar material which has sufficient strength, light weight and the like. The method of making the units is, preferably, by aluminum casting and machining, but is not limited thereto.

In the preferred embodiment, the inlet unit 101 includes a flared front end 105 which defines a somewhat bell-shaped opening for the aperture 106 which passes axially through the inlet unit 101. The flared front end is adapted to mate with the existing output flange on a conventional jet boat impeller housing (not shown). The seal 199 may be a teflon o-ring seal mounted in a groove around the perimeter of the end 105. The output end of the inlet unit 101 is in the form of a ball 107 which has the general configuration of a somewhat truncated hollow sphere. The ball 107 is an integral portion of inlet unit 101 and permits movement of the outlet unit as described infra. A flattened, generally rectilinear, mounting support 108 is provided in the inlet unit 101. In particular, the support 108 is flattened across the top thereof in order to mate with and mount to bracket 175. The bracket 175 is, normally, bolted to the support 108 by bolts 163 (seen best in FIG. 4). One end of the bracket 175 is connected to a controller in the cockpit of the boat and permits side-to-side movement of the diverter. The other end of bracket 175 is connected to the swivel arm 118 (described infra) and the on-board up-down controller.

The apertures 109 and 11 are disposed diametrically opposite one another through the surface of the inlet unit adjacent the front end 105 thereof. The apertures 109 and 111 are, essentially, smooth bores for receiving pins therein. These pins are used as a mounting point on which the inlet unit is secured to the existing pump and pivots from side-to-side which allows the boat to be steered. A threaded aperture 109A intersects with the aperture 109. A similar threaded aperture (not visible in FIG. 1) intersects with aperture 111. The threaded apertures permit the use of bolts for securing stainless steel pivot pins into a fixed position in the respective apertures.

The outlet unit 102 is a hollow casing with a somewhat larger front end 112 which encompasses the ball 107 of the inlet unit 101. The inlet end 112 of the outlet unit 102 has a bevelled or cammed front end so that the outlet unit 102 can pivot around the pivot pin 120 and the ball 107 without binding with the end of input unit 101. The output end of outlet unit 102 is slightly flared in the preferred embodiment. In addition, the outlet unit 102 includes an internal aperture 113 which passes axially therethrough. The forward portion of aperture 113, shown in dashed outline, is, as noted above, sufficiently large to encompass the outer surface of ball 107. The aft portion of aperture 113 is of substantially similar o slightly smaller diameter relative to the aperture 106 in the inlet unit 106. The inlet unit 101 and the outlet unit 102 are generally cylindrical in configuration. However, appropriate shaping and conforming thereof are provided for largely utilatarian purposes and for proper interaction between the units.

A reverse outlet 104 is, in essence, an oblate cylinder or a hollow rectilinear tube which has the upper surface thereof either joined to or coincident with the lower surface of outlet unit 102. The bottom surface 104A of reverse outlet 104 is largely planar and parallel to the upper surface wherein the outlet unit and the reverse output unit are substantially parallel to each other. The sides of the reverse outlet 104 are substantially parallel to each other, joined to the upper and lower surfaces of reverse outlet 104 and, as well, joined to the side or periphery of outlet unit 102.

The reverse outlet 104 includes an aperture 114 therethrough. It is seen that the aperture 114 does not directly interact with the aperture 113 in the outlet unit 102. In particular, the lower surface 104A of the reverse outlet terminates short of the aperture 113 and does not interfere with fluid flow through the diverter unit 100. In addition, because the lower surface 104A of the reverse outlet terminates short of the aperture 113, water flow through the reverse outlet 104 is not caused to interfere with water flow through the aperture in the outlet unit 102.

A reverse bucket 103 is, in essence, a shield which rotates about the bucket pivot 115. Typically, the pivot 115 is a rod which passes through an opening in one side of reverse bucket 103 and a counterpart aperture in the side of outlet unit 102. Conversely, the pivot 115 may be a plug which extends from either an inner surface of the side of reverse bucket 103 or the outer surface of outlet unit 102 and mates with and engages with a complementary aperture or receptacle therefor.

The outer surface 103A of the reverse bucket 103 is defined to be sufficiently large to cover the outlet portion of the outlet unit 102. That is, the outlet end of aperture 113 is completely covered by surface 103A of reverse bucket 103 when the bucket is closed. The upper lip 103B of reverse bucket 103 is provided to selectly overlap and engage the upper, outer surface of outlet unit 102. In essence, the upper surface or upper lip 103B of reverse bucket 103 provides a seat against the outlet unit 102. It is seen that the outer surface 103A of reverse bucket 103 has a curved or arcuate configuration which corresponds to the curved or arcuate configuration of the outer end of the outlet unit 102. This arrangement permits a relatively good seal between the two components so that the fluid which flows through the aperture 113 is substantially and effectively diverted when the reverse bucket is in the position shown in FIG. 1.

When the reverse bucket 103 is in the closed position shown, the fluid flow through the diverter 100 is diverted downwardly through the aperture 114 in reverse outlet 104. With the reverse flow provided by the positioning of reverse bucket 103 as shown in FIG. 1, the boat on which the diverter 100 is mounted experiences a reverse power thrusting. When the reverse bucket is in the open position (see FIGS. 3 and 4) the power jet of water created by the impeller passes directly through the diverter and moves the jet boat forward.

A boss 116 is provided to add structural strength to the sides of reverse bucket 103. The inner end 117 of each side portion of bucket 103 includes an aperture therethrough. The aperture (or other mounting arrangement) is used for connection to a bucket control device. The bucket control device (not shown) can include a cable connected to a lever (or the like) mounted in the boat and is manipulated by the operator of the boat. That is, by manipulating the control lever, the bucket can be placed in the open or closed position. This operation permits selection of the forward or reverse movement of the boat. The control system used with the diverter 100 in this invention is conventional.

In addition, a swivel arm 118 is fixedly mounted to the outer surface of outlet unit 102. A suitably contoured portion at the side of the outlet unit 102 may be provided. Typically, bolts 119 are used to mount the swivel arm 118 to the outlet unit 102. A pivot 120, in the form of a rod or pin, is shown in dashed outline in FIG. 1. The pivot 120 extends through the surface of outlet unit 102 and engages the ball portion 107 of inlet unit 101. The pivot 120 is a separate pivot which is mounted to the units when assembled. The outlet unit 102 rotates up and down (see arrow 149) around pivot 120 and, essentially, around ball 107. The swivel arm 118 includes a suitable connection means at the end 121. As with end 117 of the reverse bucket, end 121 may include an aperture to which a cable or cable fitting is mounted. The end 121 is also connected to a control unit mounted in the boat adjacent to the operator and is controlled thereby. The operation of swivel arm 118 controls the up and down movement of the outlet unit. The control units which are connected to ends 117 and 121 of the bucket 103 and swivel arm 118, respectively, are conventional.

Figure 2:
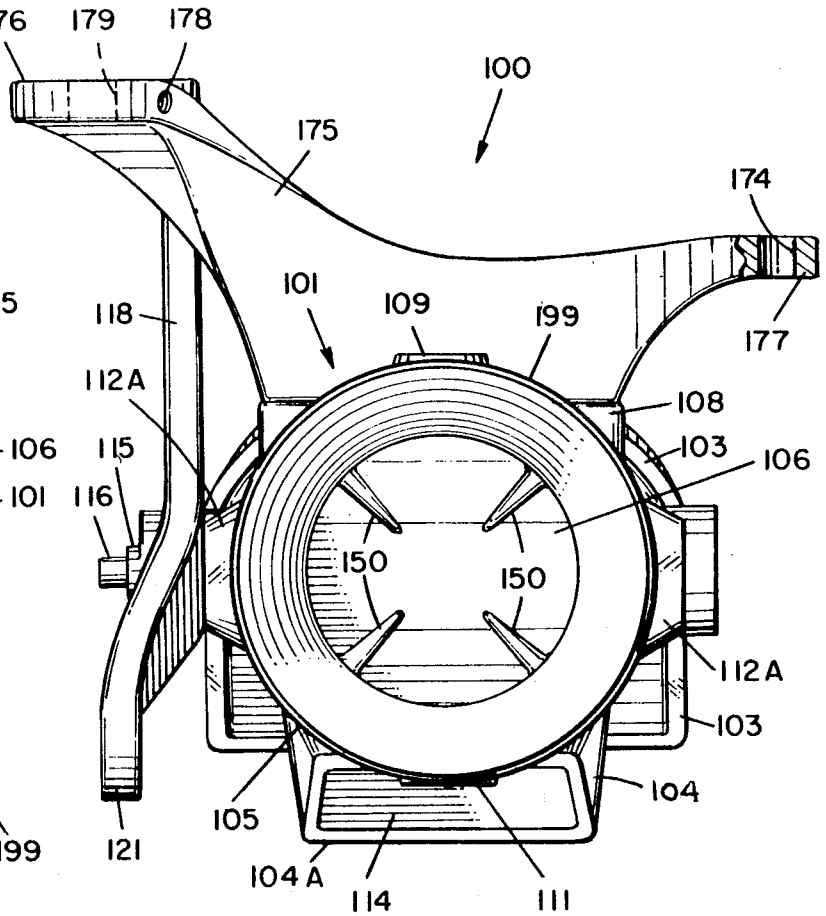
FIG. 2 is an end view of the improved diverter unit taken from the inlet end thereof.

Referring now to FIG. 2, there is shown a front end view of diverter 100 as shown and described in FIG. 1. The mounting bracket 175 is shown to include the upper end 176 (which is seen in FIG. 1) and the lower end 177. A hole 174 is provided in lower end 177 for connection to a controller, for example a cable (not shown) by which the diverter is moved from side-to-side relative to the impeller housing. The hole 179 in upper end 176 is provided for connecting a controller component to the end 121 of the swivel arm 118. A hole 178 is used to receive a set screw for assuring the proper mounting of the controller component in hole 179. As noted previously, the bottom surface of bracket 175 is placed on top of the mounting support 108 in the inlet unit. The swivel arm 118 is mounted to the boss 112A at the input portion of the outlet unit 102.

In FIG. 2, the reverse outlet 104, in particular the bottom surface 104A thereof, is shown to extend beneath the surface of both the inlet unit 101 and the outlet unit 102. Thus, neither the reverse outlet unit 104 nor the water flow therethrough interferes with the water flow through the diverter. Thus, drage on the unit is minimized. The reverse bucket 103 is shown to engage the entire outlet opening of outlet unit 102 in the configuration shown in FIG. 2.

Also, as shown in FIG. 2, a plurality of vanes 150 extend radially inwardly into the aperture 106 through the inlet unit 101. The vanes 150 are relatively thin fins which extend from the inner surface of the aperture 106 in inlet unit 101 toward the center of the aperture 106. In the embodiment shown in FIG. 2, four vanes 150 are depicted. Of course, fewer vanes or additional vanes can be utilized. In addition, the vanes are shown extending approximately two thirds of the distance diametrically across the aperture 106. The size and shape, as well as the number of vanes can be altered. The purpose of the vanes is to produce a generally laminar of "straight" flow of fluid through the diverter unit 101. In the prior art devices, the fluid flows in a spiral motion through the diverter thereby causing a deleterious effect at the output of the unit which adversely affects the operation of the boat. The spiral motion is caused by a power driven impeller inside the pump propelling the jet boat and rotatably driven by the power source In this invention, the vanes cause the fluid flow to be "straightened" and thereby to have no adverse effect on the operation of the boat in terms of control, steering or the like. This avoids the major problems that jet boats encounter because of the impeller operation.

Figure 3:
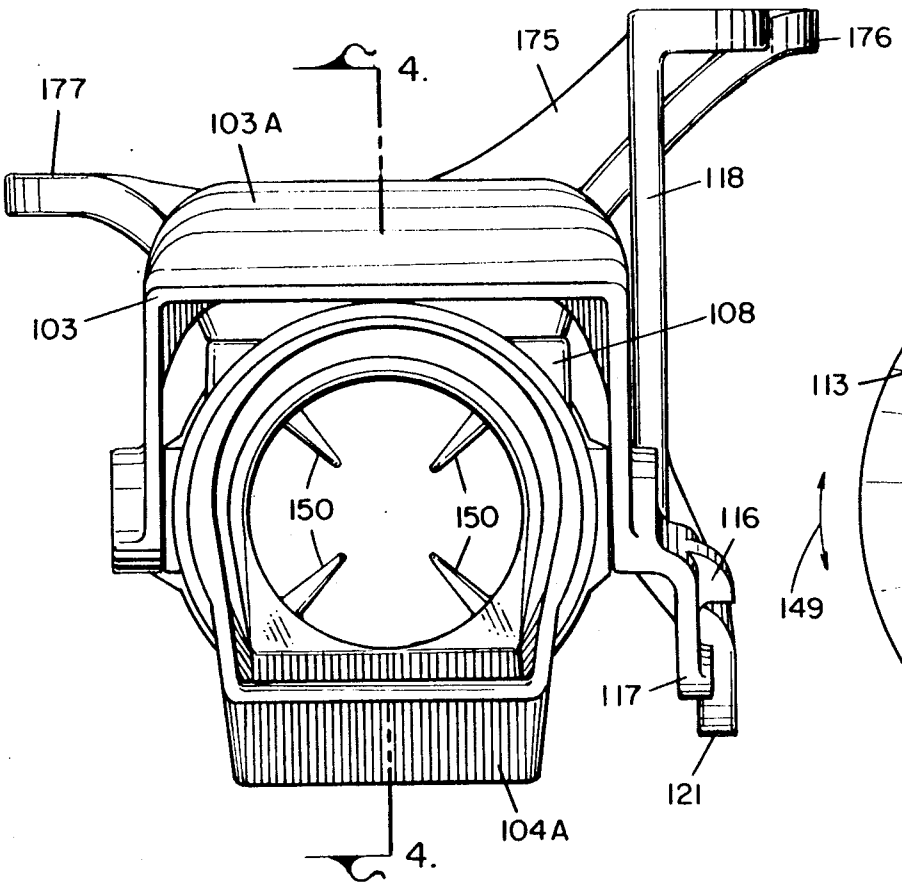
FIG. 3 is an end view of the improved diverter unit taken from the outlet end thereof.

Referring now to FIG. 3, there is shown a rear view of the diverter 100 with the reverse bucket 103 in the raised or open position. In this instance, the apertures 106 and 113 communicate directly and fluid flows directly through the diverter 100. Because of the positioning of the lower surface of reverse outlet 104 relative to the apertures 106 and 113, virtually no fluid is diverted through the reverse outlet 104 in this configuration wherein fluid flow through the diverter unit does not produce drag at the reverse outlet 104.

The configuration of the vanes 150 in this view is clear wherein the operation thereof to provide a laminar flow is demonstrated. In the preferred embodiment, the vanes 150 are spaced equidistant around the aperture. However, other arrangements are contemplated.

As noted above, the bucket 103 is controlled by control means (not shown) attached to the control unit 117 of the reverse bucket. It should also be noted that the position of the outlet unit 102 can be moved up and down as shown by the arrows 149. That is, when the conventional control unit is operated, the swivel arm 118 is caused to pivot around the pivot pin 120. Because swivel arm 118 is fastened to outlet unit 102 by the bolts 119, the outlet unit 102 is also caused to pivot around pivot 120. In essence, the outlet unit 102 pivots around the ball 107 and can direct the fluid through the system in an upwardly or downwardly flow. Furthermore, by manipulating both swivel arm 118 and reverse bucket 103, a significant change in the direction of fluid flow through the diverter is provided.

Figure 4:
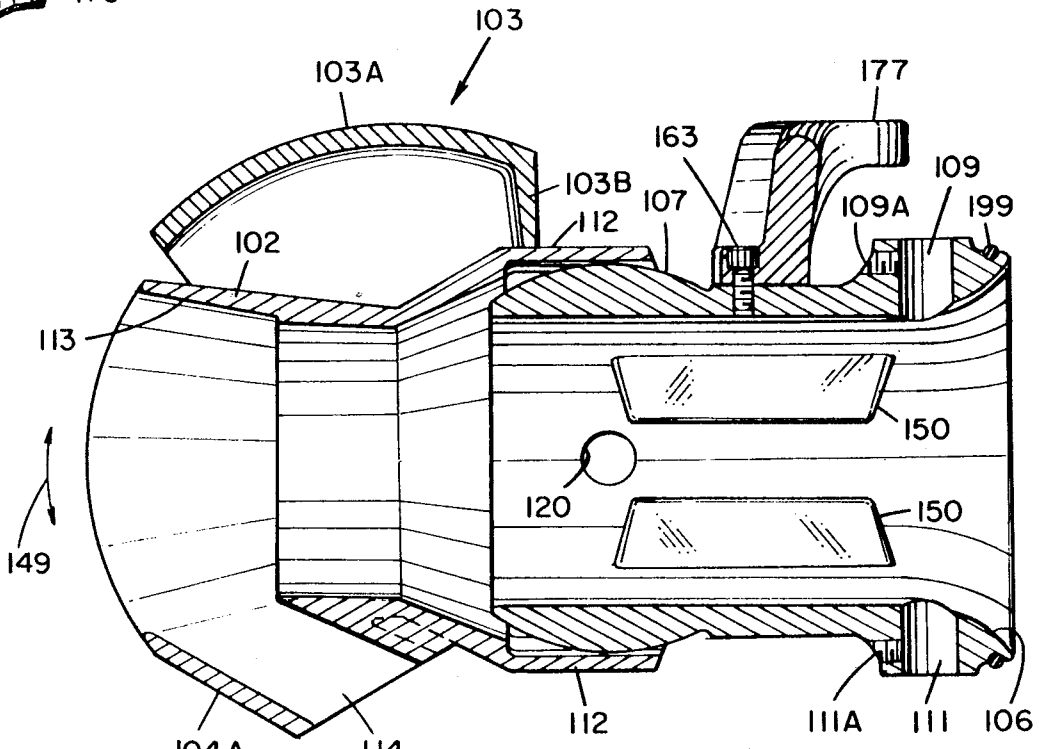
FIG. 4 is a cross-sectional view of the improved diverter unit of the instant invention.

Referring now to FIG. 4, there is shown a cross sectional view of the diverter 100 taken along the lines 4—4 in FIG. 3. In this representation, the reverse bucket 103 is in the raised position (as shown in FIG. 3). Likewise, FIG. 4 shows the relationship of the input unit 101 and the output unit 102 in terms of the engagements between the two units at ball 107. The vanes 150 are shown to extend inwardly into the aperture 106 in inlet unit 101. The pivot pin 120 which engages ball 107 and outlet unit 102 is shown. The holes 109 and 111 are also shown. These holes receive pins for rotatably mounting the diverter 100 to the impeller housing (not shown). The teflon o-ring 199 provides a seal between the diverter and the impeller housing. The set screw holes 109A and 111A are used for securing the mounting pins to the diverter when assembled.

Also, in FIG. 4, the relationship between the trailing edge or lip 104B of the reverse outlet 104 relative to the apertures 106 and 113 is clearly seen. Thus, the lower surface of the reverse outlet does not interfere with the fluid flow through the diverter as occurs in the prior art.

Thus, there is shown and described an improved version of the fluid flow diverter which is used with jet boats. This unit has several advantages in that normal drag is reduced; controlling of the boat is rendered easier; steering is equally available in either direction because of the vanes in the unit and so forth. Of course, those skilled in the art may conceive of modifications or varifications to this embodiment. However, any such modifications or variations which fall within the purview of this description are intended to be included therein as well. It is understood that the description herein is intended to be illustrative only and is not intended to be limitative. Rather, the scope of the invention described herein is limited only by the claims appended hereto.

I claim:

1. An improved diverter for use with a jet boat comprising, inlet means having an axial aperture therethrough, outlet means having an axial aperture therethrough, said inlet means and said outlet means have generally hollow cylindrical configurations, the rearward end of said inlet means comprises a ball-shaped housing, the forward end of said outlet means is pivotally mounted to the rearward end of said inlet means by a pivot pin which passes through the surfaces of both said inlet means and said outlet means so that the respective apertures therethrough are substantially aligned, swivel arm means connected to said outlet means and pivotable therwith relative to said inlet means, reverse outlet means having an axial aperture therethrough, said reverse outlet means is formed in the configuration of an oblate cylinder which has a relatively flat lower surface whereby fluid flow therethrough is relatively unimpeded in order to enhance operation of said jet boat, said reverse outlet means disposed adjacent to said outlet means so that the axial apertures through said outlet means and said reverse outlet means are arranged at an acute angle so as to be nearly parallel to each other whereby said apertures through said outlet means and said reverse outlet means are axially displaced from each other and do not cause interaction of fluid flow through said outlet means and said reverse outlet means in the absence of a reverse bucket means whereby drag on said jet boat is reduced, reverse bucket means pivotally mounted to said outlet means and adapted to selectively close the aperture through said outlet means thereby to divert fluid flow from said inlet means through said reverse outlet means, and vane means attached to the interior of at least on of said inlet means and said outlet means and extending radially into the aperture thereof.

2. The diverter recited in claim 1 including, connection means disposed at the forward end of said inlet means for selectively connecting said diverter to a propulsion means on said jet boat.

3. The diverter recited in claim 2 including, seal means disposed at said forward end of said inlet means to provide a substantially fluid-tight seal between said diverter and said propulsion means.

4. The diverter recited in claim 1 wherein, said outlet means moves in an up/down relationship with respect to said inlet means.

5. The diverter recited in claim 1 wherein, said reverse bucket means is arcuate in configuration.

6. The diverter recited in claim 1 wherein, said vane means includes at least one rib which extends along the length of the associated aperture.

* * * * *